US005901772A

United States Patent [19]

Hoshina

[11] Patent Number: 5,901,772

[45] Date of Patent: May 11, 1999

[54] METHOD FOR CASTING PISTONS

[75] Inventor: Masaharu Hoshina, Saitama-ken, Japan

[73] Assignee: Izumi Industries, Ltd., Japan

[21] Appl. No.: 08/739,824

[22] Filed: Oct. 30, 1996

[30] Foreign Application Priority Data

Nov. 24, 1995 [JP] Japan ..... 7-305803

[51] Int. Cl.[6] ..... B22D 19/00

[52] U.S. Cl. ..... 164/112; 29/888.047; 29/888.049; 92/222; 123/193.4; 164/334; 249/91

[58] Field of Search ..... 164/98, 112, 334, 164/DIG. 8; 29/888.047, 888.049; 123/193.4; 92/211, 222, 223, 224, 225; 249/91

[56] References Cited

U.S. PATENT DOCUMENTS 2,851,318 9/1958 Smith et al. ..... 92/222
3,380,139 4/1968 Kis et al. ..... 29/888.047
3,471,914 10/1969 Strauss ..... 29/888.047
4,905,751 3/1990 Dupin ..... 164/334 X

FOREIGN PATENT DOCUMENTS 1-130865 5/1989 Japan ..... 164/98

*Primary Examiner*—J. Reed Batten, Jr.
*Attorney, Agent, or Firm*—Morrison Law Firm

[57] ABSTRACT

A ring carrier, for use in a piston casting die, is an annular-shaped member having a channel on an outer surface area. The piston casting die includes projections for engaging the channel and supporting the ring carrier within the piston casting die. At least one of the projections is fixed and at least one other of the projections is movable into and out of the piston casting die. The movable projection includes a driving member for urging the movable projection into engagement with the channel for supporting the ring carrier at a predetermined position within the piston casting die.

5 Claims, 2 Drawing Sheets

METHOD FOR CASTING PISTONS

BACKGROUND OF THE INVENTION

The present invention relates to an improved ring carrier used for improving wear resistance in the piston ring grooves of pistons for internal combustion engines, particularly pistons made from cast aluminum alloys. The present invention also relates to a method casting-in the ring carrier integrally in an aluminum alloy piston.

In this specification, the term "ring carrier" is used to refer to all of the ring carriers by itself before it is integrally cast-in the piston, the ring carrier that has been integrally cast-in the piston, and the ring carrier that has been finished via machine processing.

Ring carriers, generally made from stainless steel or cast Niresist, are used for aluminum alloy pistons in order to improve wear resistance at the attachment groove of the piston ring.

When casting this type of piston, the ring carrier is set inside the mold, and the ring carrier is integrally cast-in by filling the mold with a molten aluminum alloy. Conventionally, an annular ring flange of a square section is formed on the outer periphery of the ring carrier so that the ring can be mounted and fixed in the mold.

In general, the following processes are involved in casting in a ring carrier. The ring carrier is immersed in molten aluminum beforehand to produce an adequate bond layer between the ring carrier and aluminum. The bond layer with aluminum is produced over the entire surface of the ring carrier. Then the ring carrier is fixed in the mold in such away that excess space is formed between the ring carrier fixed in the mold and the outer mold so that the entire ring carrier can be totally surrounded by the molten metal poured in the mold. Thus the ring carrier is cast-in and metallurgically bonded with aluminum alloy piston.

When using a ring carrier with a flange as described above, the maximum outer diameter of the ring carrier used is greater than that of the piston. This requires the piston cast to have a larger outer diameter. This is wasteful of raw materials and uneconomical. Furthermore, the precision in the attachment of the ring carrier to the mold is lowered and automation of the attachment process is made difficult. Considerable excess mass gets left on the piston cast around the flange. This makes extra steps in the machine-processing stage necessary to eliminate the excess mass and also results in a great deal of chips comprising mixtures of aluminum and Niresist cast iron or stainless steel.

OBJECTS AND SUMMARY OF THE INVENTION

The object of the present invention is to overcome the problems of the prior art described above. A further object of the present invention is to provide a novel ring carrier and a method for casting pistons having the following characteristics: production is economical since the maximum outer diameter of the ring carrier is roughly equal to that of the cast piston, thus decreasing raw material costs; the ring carrier can be attached to the mold automatically with high precision; the cast piston has minimal excess mass so that material is not wasted and excess machine processing steps are not required; and dust chips are minimized.

The objects described above are achieved with a ring-shaped ring carrier, having a roughly square cross-section, on which is formed a thin groove along the entire outer periphery.

This thin groove may be formed continuously along the entire outer periphery surface of the ring carrier, or it may be formed discontinuously along a single circumference on the outer periphery surface.

The cross-section shape of the thin groove is not specifically restricted, but a V shape or a U shape is desirable.

Niresist cast iron or stainless steel is recommended as the material for the ring carrier, but it is not restricted to these materials.

The method for casting pistons of the present invention uses a casting device comprising a die and a driving device. The die for casting pistons comprises an outer mold, an inner mold and an upper mold. Movable fixing pins are disposed along a single circumference of a cylinder-shaped inner wall of the outer mold. The movable fixing pins, which can move in and out along a radial direction of the inner wall of the outer mold, are disposed at positions on the inner wall corresponding to a fixing position of a ring carrier in a piston. The driving device moves the movable fixing pins in and out of the inner wall of the outer mold along the radial direction. A ring carrier is inserted into and supported at a prescribed position within the outer mold. The ring carrier has an annular member with an outer surface. The outer surface of the annular member has a thin groove for receiving ends of the movable fixing pins. The movable fixing pins are moved forward toward the central axis of the outer mold. The ends of the movable fixing pins are fitted to the thin groove on the outer periphery of the ring carrier. The dies are then closed and a molten aluminum alloy is poured in the mold. Thus, the ring carrier is cast-in the piston.

It is recommended that the driving device used for the movable fixing pins comprises a spring or an air cylinder.

The present invention, configured as described above, keeps material costs for the ring carrier low and allows automated fixing of the ring carrier in the die with a high degree of accuracy. Furthermore, there is little excess mass on the piston cast. Thus, extra machine-processing steps are not required, material is not wasted, and chips particles are not generated. The present invention allows low-cost production of pistons, and its implementation has many advantages.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
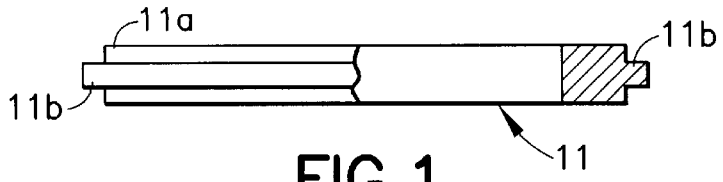
FIG. 1 PRIOR ART
FIG. 1 is a partially cut-away front view showing one example of a widely used prior art ring carrier.

Referring to FIG. 1, the following is a description of a prior art ring carrier 11.

Referring to FIG. 1, prior art ring carrier 11 comprises a ring-shaped main body 11*a* whose end view on a cutting plane perpendicular to the tangent line is roughly square in shape. A shallow flange 11*b* having a small vertical dimension is formed along a circumference of main body 11*a*.

In the example shown in the drawings, flange 11*b* is disposed at roughly the midpoint of the thickness of main body 11*a*. However, flange 11*b* can be disposed anywhere on the periphery of main body 11*a* and can, for example, be disposed at the upper end or the low end of main body 11*a* in the drawing.

Figure 2:
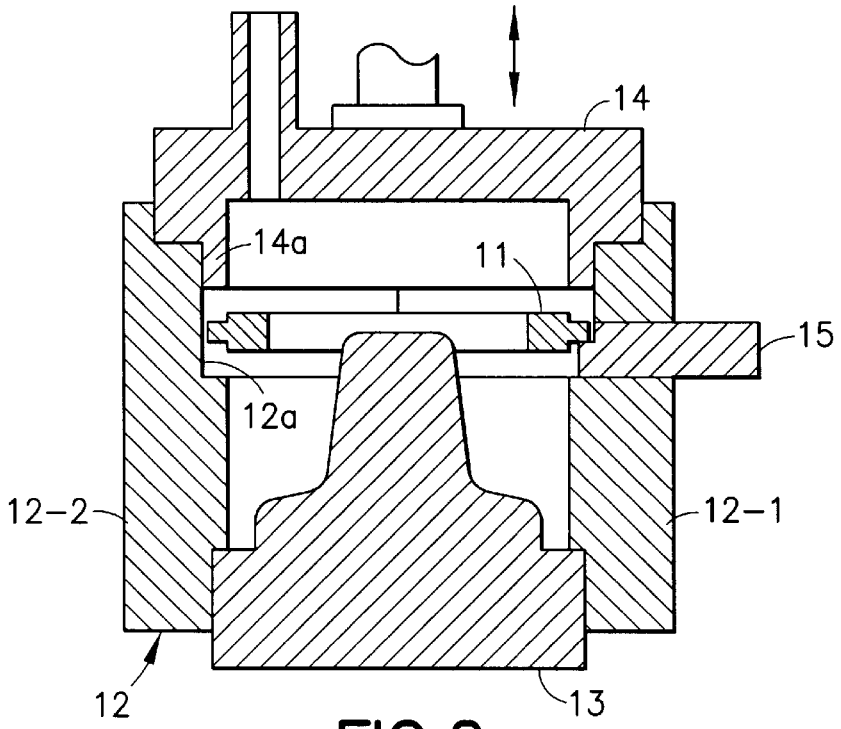
FIG. 2 PRIOR ART
FIG. 2 is a cross-sectional view showing the ring carrier in FIG. 1 mounted in a die.

Referring to FIG. 2, ring carrier 11 is set inside a die for casting pistons.

Referring to FIG. 2, there is shown the die in a closed state with ring carrier 11 set in the die.

Referring to the drawing, the right half of the cross-section of FIG. 2 shows the ring carrier supported by a fixed attachment projection, but the left half of FIG. 2 shows the ring carrier portion unsupported by a fixed attachment projection.

In order to simplify the drawing, the closing device for the die, the releasing device for removing the cast and the pouring device are not shown.

Referring to FIG. 2, a split type outer mold 12 comprises a split mold 12-1 and a split mold 12-2. There are also shown an inner mold 13 and an upper mold 14. A plurality of fixed attachment projections 15 is disposed on outer mold 12 to allow mounting of ring carrier 11.

Fixed attachment projections 15 are inserted and fixed in a plurality of insertion holes disposed along a single circumference selected to correspond with the attachment position of the ring carrier. The insertion holes, which are oriented radially and disposed symmetrically in side walls of outer mold 12, serve to support ring carrier 11 when outer mold 12 is closed.

To cast-in the ring carrier in a piston, outer mold 12 is closed and ring carrier 11 is mounted on the upper surfaces of fixed attachment projections 15. Then, upper mold 14 is mounted on top of outer mold 12, thus closing the dies.

As described above, ring carrier 11 needs to be surrounded over its entire surface by molten aluminum. Thus, ring carrier 11 is not constrained anywhere except where it is supported by fixed attachment projections 15. As shown in the left half of FIG. 2, there is a free space between the ring carrier and the dies (14*a*, 12*a*).

Thus, in the past, experienced worker had to cast a piston by having ring carrier 11 supported coaxially with outer shell 12.

Using this prior art method, however, it is difficult even for experienced workers to cast a piston so that ring carrier 11 is supported completely coaxially with outer mold 12. The scrap rate was high. Furthermore, the excess mass that surrounds flange 11*b*, disposed around ring carrier 11, means that the maximum outer diameter of the cast ends up being considerably greater than the outer diameter required for the piston.

Ring carrier 11 is cut to separate pieces by using a lathe from a centrifugally cast cylindrical tube of Niresist iron or stainless steel. As a first machining step, the cast long cylindrical tube is machined on the inner and outer surfaces i.e. the surfaces corresponding to the inner surface of main body 11*a* of ring carrier 11 and the outer surface of flange 11*b* . Then, the surface of the free end face of the cylinder is finished on a lathe so that it can serve as the reference surface for ring carrier 11. The surfaces to both sides of flange 11*b* are cut with a lathe to form a projection, and the two end surfaces and the end surface of flange 11*b* are finished. This completes ring carrier 11.

When ring carrier 11 is formed in this shape, the Niresist cast, which serves as the base material, needs to be fairly thick. The mass of the cylindrical tube is at least 1.5 times the mass of finished ring carrier 11. Thus the amount of wasted material is significant.

Figure 3:
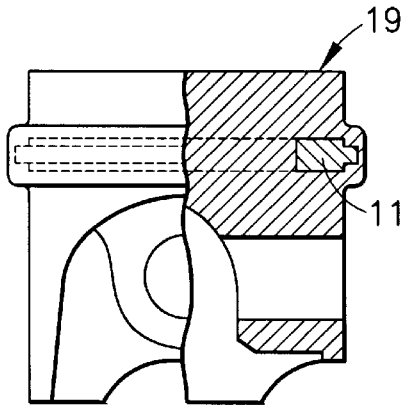
FIG. 3 PRIOR ART
FIG. 3 is a partially cut-away front view showing an example of a piston cast that was cast with the die shown in FIG. 2.

Ring carrier 11 is mass produced on high-speed automatic lathes using the steps described above. Thus, some margin of error must be allowed in the thickness of flange 11*b*, the distance between the center surface of the flange and the end surface serving as the reference surface, and the outer diameter of main body 11*a* where flange 11*b* is not present. Furthermore, as described above, ring carrier 11 must be accurately positioned coaxial with the die. Thus, the piston cast in this type of die will result in considerable excess mass, as shown in FIG. 3.

Furthermore, as an allowable error is permitted for eccentricity of ring carrier 11 in a piston, ring carrier 11 itself must be made thicker in order that the ring groove makes sure that the ring groove is properly formed of the piston can be properly cast-in the ring carrier with some eccentricity.

Thus, ring carrier 11 must be made thicker than necessary, and a significant amount of excess mass is found around the cast-in ring carrier in the piston. These problems result in wasted materials and an increased number of machine processing steps.

Figure 4:
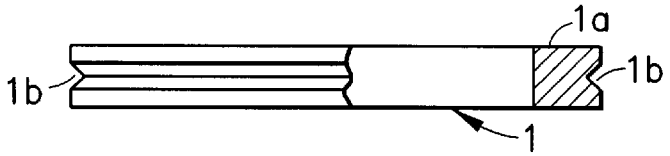
FIG. 4 is a partially cut-away front view showing an embodiment of the ring carrier of the present invention.

On the other hand, referring to FIG. 4, a ring carrier 1 of the present invention comprises a main body la and a single V-shaped groove 1*b* formed on the outer perimeter.

Ring carrier 1 may also be formed from a cylindrical body of Niresist cast iron or stainless steel. However, no flange is formed on the outer periphery of main body 1*a*, and ring carrier 1 is accurately supported coaxially with an outer mold 2. Thus, when ring carrier 1 is to be integrally cast-in the piston, the excess mass on the outside can be made very thin. This reduces the amount of material needed and is economical. Since the axial location of the ring carrier is accurately fixed, the present invention can be implemented for "high top ring" grooves as well.

Figure 5:
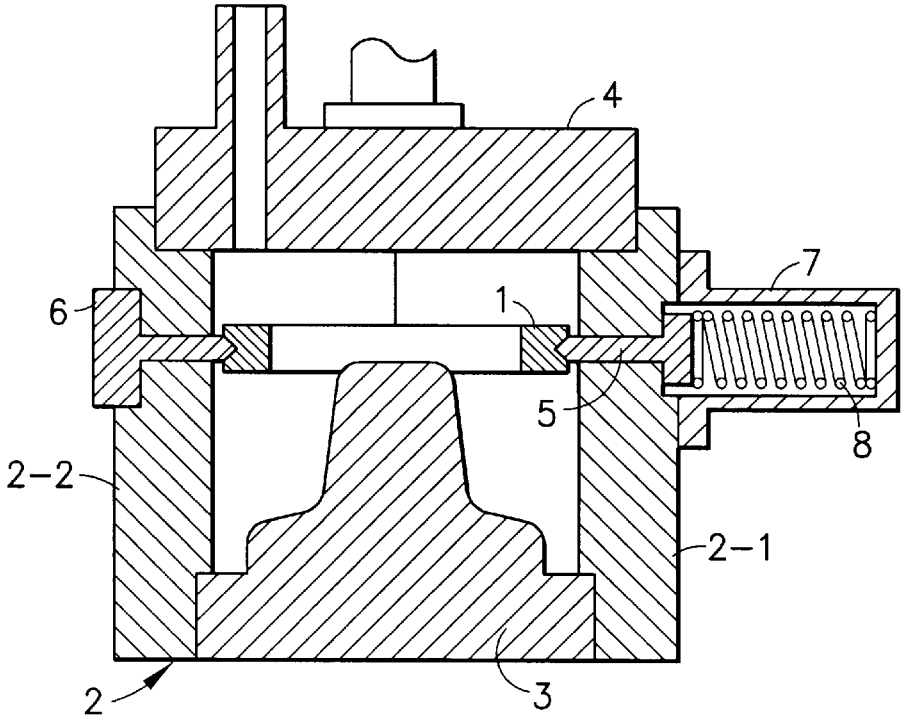
FIG. 5 is a cross-sectional view showing the ring carrier in FIG. 4 mounted in a die.

Referring to FIG. 5, there is shown a die used for casting a piston with ring carrier 1.

This die comprises: a split type outer mold 2 comprising two partial molds 2-1 and 2—2; a center mold 3; and an upper mold 4. The partial mold 2-1 comprises a movable fixing pin 5 and the partial mold 2—2 comprises a fixed fixing pin 6. Referring to the drawing, there is shown one each of movable fixing pin 5 and fixed fixing pin 6, but a plurality of these pins 5 and 6 may be disposed as needed so that reliable support can be provided for ring carrier 1.

Referring to the embodiment shown in the FIG. 5, movable fixing pin 5 is always pressed toward the center of the die by a driving device comprising a casting 7 and a spring 8. Movable fixing pin 5 supports ring carrier 1 and presses ring carrier 1 toward the center of the die, mounted at a position that is opposed to fixed fixing pin 6. Thus, movable fixing pin 5 works together with fixed fixing pin 6 to maintain correct positioning of ring carrier 1.

Comparing FIG. 5 and FIG. 2, outer mold 2 and upper mold 4 are simpler in shape than outer mold 12 and upper mold 14 of the die used for prior art ring carrier 11. Thus, it is clear that lower production costs and maintenance costs are required.

Figure 6:
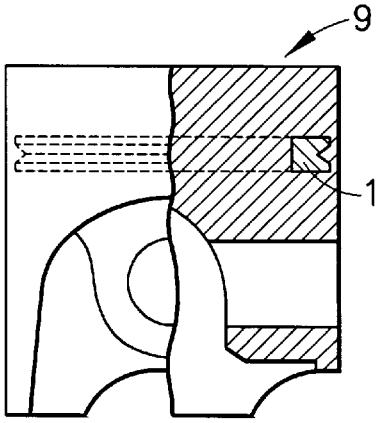
FIG. 6 is a partially cut-away front view showing an example of a piston cast that was cast using the die shown in FIG. 5.

Referring to FIG. 6, a piston cast with this die does not have excess mass projecting from the outer periphery surface, and casting-in of the ring carrier is performed while the ring carrier is supported completely coaxial with the die. Thus, the thickness of the excess mass can be kept to a minimum without resulting in defective products due to bad positioning of the ring carrier. This results in a very low scrap rate. Also, since thin groove 1*b* is positioned accurately, the cross-sectional dimensions of the ring carrier can be kept at a minimum. Thus, wasted material can be kept at a minimum and costs can be reduced.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, the shape of the cross-section of the ring carrier and the shape of the groove can be selected as appropriate. For example, the groove does not have to be V-shaped and can be U-shaped or square instead. Also, the groove does not have to be continuous along the entire periphery of the ring carrier, and can be formed discontinuously. The shapes of the die, the movable fixing pins and the fixed fixing pins can also be freely modified as long as the objects of the present invention are achieved.

What is claimed is:

1. A method for casting a piston in a piston casting die including the steps of:

withdrawing at least one movable fixing pin from a cavity of said piston casting die;

placing an annular-shaped ring carrier having a groove on an outer surface into said piston casting die such that said groove engages at least one fixed fixing pin in said piston casting die;

engaging said at least one movable fixing pin in said groove by urging said at least one movable fixing pin toward said groove whereby said ring carrier is supported by said at least one movable fixing pin and said at least one fixing pin;

closing said piston casting die; and pouring molten metal into said piston casting die, whereby said ring carrier is integrally cast-in the piston.

2. A piston casting die, comprising:

a piston mold portion bounding a piston cavity of said casting die;

at least one fixed fixing pin attached to said piston casting die on an inner wall of said piston mold portion;

at least one movable fixing pin being movably mounted on said piston mold portion such that said at least one movable fixing pin is movable through said inner wall in a substantially radial direction with respect to a center of said piston cavity;

each of said at least one movable fixing pin and said at least one fixed fixing pin having an innermost end toward a center of said piston cavity;

an annular-shaped element having a groove on an outer surface for receiving said innermost end of said at least one fixed fixing pin and said at least one movable fixing pin;

a driving device urging said at least one movable fixing pin toward said center of said piston cavity along said substantially radial direction so that said annular-shaped element is supported by said innermost end of said at least one fixed fixing pin and said innermost end of said at least one movable fixing pin at a prescribed position within said piston cavity;

means for receiving a molten metal into said piston cavity, whereby a piston cast is formed integrally with an internally cast-in ring carrier in an area of said piston cast surrounding said annular-shaped element.

3. The piston casting die of claim 1, wherein said groove of said annular-shaped element is continuous along said outer surface of said annular-shaped element.

4. The piston casting die of claim 1, wherein said groove of said annular-shaped element is discontinuous along a single circumference on said outer surface of said annular-shaped element.

5. The piston casting die of claim 1, wherein said groove of said annular-shaped element is V-shaped.

* * * * *